US008256621B2

(12) United States Patent
Deiger et al.

(10) Patent No.: US 8,256,621 B2
(45) Date of Patent: Sep. 4, 2012

(54) LOAD TRAY AND METHOD FOR UNITIZING A PALLETIZED LOAD

(75) Inventors: Anthony J. Deiger, Perrysburg, OH (US); William T. Peters, Jr., Perrysburg, OH (US)

(73) Assignee: Pro-Pak Industries, Inc., Maumee, OH (US)

( * ) Notice: Subject to any disclaimer, the term of this patent is extended or adjusted under 35 U.S.C. 154(b) by 165 days.

(21) Appl. No.: 12/807,732

(22) Filed: Sep. 13, 2010

(65) Prior Publication Data

US 2011/0062049 A1 Mar. 17, 2011

Related U.S. Application Data

(60) Provisional application No. 61/276,453, filed on Sep. 11, 2009.

(51) Int. Cl.
*B65D 19/00* (2006.01)

(52) U.S. Cl. ..... 206/600; 108/55.1; 108/51.3; 53/397

(58) Field of Classification Search ..... 206/386, 206/597, 600; 108/55.1, 51.3; 53/397, 441, 53/449

See application file for complete search history.

(56) References Cited

U.S. PATENT DOCUMENTS

| | | | | | |
|---|---|---|---|---|---|
| 2,628,715 | A * | 2/1953 | Budd | 206/597 |
| 2,762,551 | A * | 9/1956 | Fallert | 206/386 |
| 3,088,619 | A * | 5/1963 | Boucher | 220/1.5 |
| 3,524,415 | A * | 8/1970 | Heiman | 108/53.3 |
| 3,805,473 | A * | 4/1974 | Lidgard | 53/397 |
| 4,013,168 | A * | 3/1977 | Bamburg et al. | 206/386 |
| 5,353,936 | A * | 10/1994 | Dockstader et al. | 206/597 |
| 6,241,148 | B1 * | 6/2001 | Schwimmer | 229/122.21 |
| 7,654,390 | B2 * | 2/2010 | Baechle et al. | 206/386 |
| 7,896,159 | B2 * | 3/2011 | Goda | 206/386 |
| 2008/0023359 | A1 * | 1/2008 | Churvis et al. | 206/386 |
| 2011/0048990 | A1 * | 3/2011 | Goda | 206/386 |

* cited by examiner

*Primary Examiner* — Jacob K Ackun
(74) *Attorney, Agent, or Firm* — David C. Purdue

(57) ABSTRACT

A new load tray especially well suited for use under loads on pallets is disclosed. The tray has a central load supporting base and as many as four flaps hingedly connected to the base. The tray includes flap supports for supporting the flaps and releasably maintaining them at a 90 to 135 degree angle relative to the base. The tray is designed so that it may be positioned on a pallet and have a load placed on it so that the flaps remain in an upstanding position so that when the load is wrapped, the flaps are held captive against the load.

4 Claims, 12 Drawing Sheets

LOAD TRAY AND METHOD FOR UNITIZING A PALLETIZED LOAD

BACKGROUND OF THE INVENTION

1. Field of the Invention

The present invention is a load tray for supporting and protecting a load, especially a load that is to be placed on a pallet. The invention is particularly advantageous when used in between a pallet and a load when the palletized load is wrapped, to unitize the pallet and the load, because the load tray according to the invention acts to minimize damage to the load and maximize the integrity of the load.

2. Description of the Prior Art

Today, many different products are shipped from the point where they are manufactured and/or packaged to distribution outlets from whence they are shipped again to retail outlets. Many grocery items, for example, are packaged in packages which are placed, in groups, onto pallets. The palletized loads are very often unitized by wrapping either with a stretch wrap or a heat shrink wrap. In the grocery business, pallets are widely used and they are highly standardized in terms of size. The Grocery Manufacturers of America ("GMA") actually has a pallet Subcommittee which recommends, from time to time, specifications for the standard GMA pallet which is 48 inches by 40 inches and designed to handle up to 2,800 pounds of payload. However, grocery items are not standardized in terms of size across the board and the sizes of grocery item loads are not standardized with reference to the standard size grocery pallet. This is true outside of the grocery business, too. Consequently, some pallet loads have a footprint that is smaller than the upper, load bearing surface of a pallet on which the load will be transported. Some loads have a footprint that is just about the size of the upper bearing surface of a pallet on which it will be transported and some loads have a footprint that is bigger than the upper bearing surface of a pallet on which the load will be transported.

All palletized loads are subject to being damaged in transit or in storage, some more than others. Bagged goods are especially prone to being damaged and especially prone are the bags of goods that are on or near the bottom of a palletized load. Prior art has been developed to address the issue of damaged goods on pallets. Flat sheets of paperboard, corrugated fiberboard, corrugated plastic and the like have been used between the upper bearing surfaces of pallets and the loads placed thereon. Trays with pre-glued side walls have also been used. Neither the flat sheet nor the tray works well when wrapping a palletized load with shrink wrap or stretch wrap to unitize the load. Thus, there remains a need for the development of products and processes that can reduce the losses associated with damage to palletized goods, especially when the palletized goods are to be unitized as by wrapping.

SUMMARY OF THE INVENTION

The instant invention is based upon the discovery of a new load tray especially well suited for use under loads on pallets. The tray has a central load supporting base and as many as four flaps hingedly connected to the base. The tray includes flap supports for supporting the flaps and releasably maintaining them at a 90 to 135 degree angle relative to the base. In between adjacent flaps, in some embodiments, there is an exposed corner portion of the base with an edge and an adjacent edge region that is made up of flexible fingers produced by cuts made transversely to the edge so that the edge of each edge region is actually comprised of a plurality of edges of the fingers that constitute the edge region.

Flap supports may take many forms. For example, the supports may consist of plastically deformable members such as metal rods which coact with the base and at least one of the flaps. The flap supports may take the form of elastic supports which engage a flap and the base or one or more adjacent flaps. Other embodiments of the flap supports are described in some detail below.

Thus, it is an object of the invention to provide a tray to protect a palletized load and especially the lower portion of the load.

It is a further object to provide such a tray that is compatible with modern wrapping equipment.

It is yet another object of the invention to provide a tray that reduces damage to a wrap applied to a load on the tray, by comparison with prior art flat sheets and prior art glued trays.

Other objects and advantages will be apparent to one skilled in the art from the description herein, reference being made to the attached drawings.

BRIEF DESCRIPTION OF THE DRAWING FIGURES

DETAILED DESCRIPTION OF THE INVENTION

Figure 1:
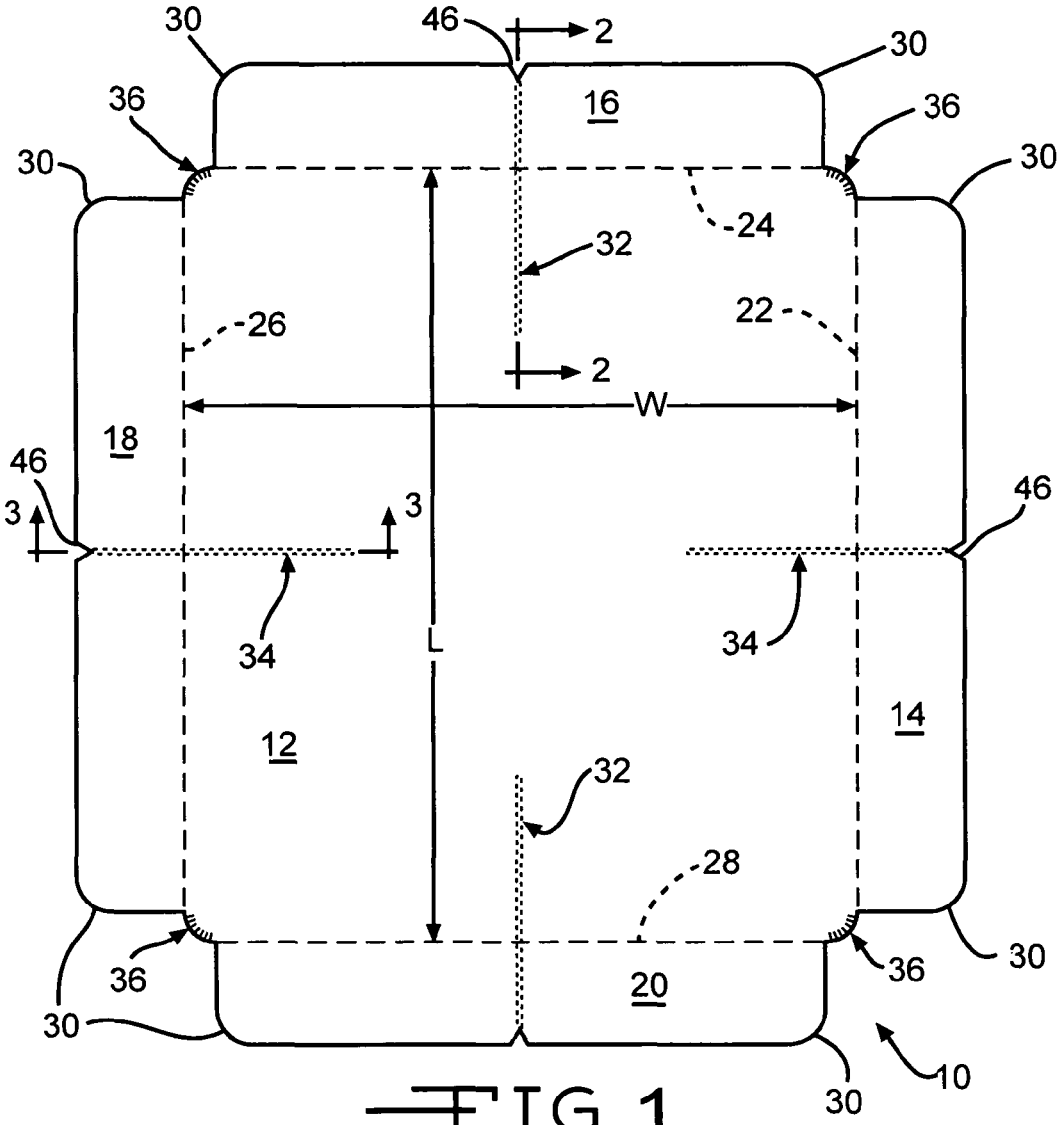
FIG. 1 is a plan view of a blank for producing a load tray according to the invention.

Referring now in more detail to the drawing figures, a blank for producing a load tray according to the invention is indicated generally at 10 in FIG. 1. The blank 10 comprises a central load supporting base 12 surrounded by four flaps 14, 16, 18 and 20. The flap 14 is integral with the base 12 but hingedly connected thereto along a score line 22. Similarly, the flaps 16, 18 and 20 are integral with the base 12 and hingedly connected thereto along score lines 24, 26 and 28, respectively. The flaps 14, 16, 18 and 20 have rounded corners 30 for reasons that are discussed below. Plastically deformable flap positioners indicated at 32 are provided for flaps 16 and 20 and they are shown in some detail in FIG. 2 and discussed below in reference thereto. Plastically deformable flap positioners indicated at 34 are provided for flaps 14 and 18 and they are shown in some detail in FIG. 3 and discussed below with reference thereto.

The central base 12 has a width W and a length L. Flap 14 and flap 18 extend outwardly from the base 12 and they have a width that extends length-wise relative to the length L of the base. Flap 16 and flap 20 extend outwardly from the base 12 and they have a width that extend width-wise relative to the width W of the base. The width of the flaps 14 and 18 is less than the length L of the base. Similarly, the width of the flaps 16 and 20 is less than the width W of the base. One result is that the flap 14, and the flaps 16, 18 and 20, can be pivoted, from the positions shown in FIG. 1, about the score line 22, and the score lines 24, 26 and 28, relative to the base 12, until the flap 14, and the flaps 16, 18 and 20 form angles of ninety degrees with the base 12, so that the flaps 14, 16, 18 and 20 stand straight up from the base 12. In this position, the flaps 14, 16, 18 and 20 will not touch each other and, in fact, they can be pivoted further to form acute angles with the base 12 and still not touch each other. This is discussed further, below, with reference to FIGS. 7, 8 and 12.

Because the flaps 14 and 18 are not as wide as the length of the base 12 and because the flaps 16 and 20 are not as wide as the width of the base 12, corners, indicated at 36, of the base 12 are exposed between the flaps 14, 16, 18 and 20. The corners 36 are rounded. The corners have been further treated to reduce damage to wrapping that is applied to a palletized load including the load tray 10. Specifically, the rounded corners 36 have been cut several times to produce multiple flexible conformable fingers which are illustrated in more detail in FIG. 11 and discussed below with reference thereto. The cuts extend in generally radial directions, relative to the curvature of the rounded corners 36.

Figure 2:
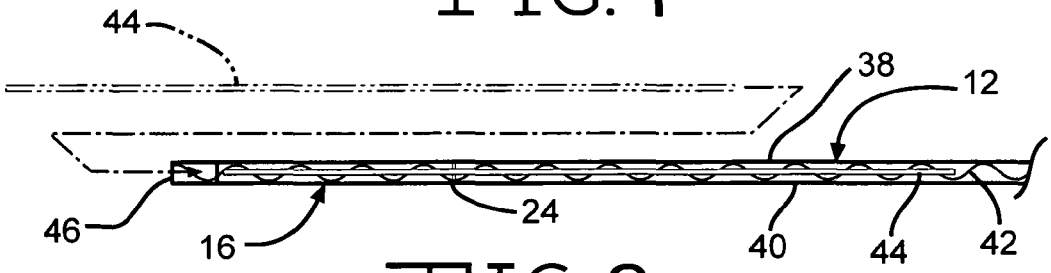
FIG. 2 is a cross-sectional view, taken along the line 2-2 of FIG. 1.

Referring now to FIG. 2, a cross-sectional view of the central base 12 and the flap 16 reveals that they are comprised of a single sheet of single wall corrugated board and they are separated by score lines 24. The corrugated board is comprised of a first liner 38, a second liner 40 and a sheet 42 of corrugated material sandwiched in between. It can be seen that the flutes of the corrugated material extend in the direction of the width W of the base 12. A plastically deformable flap positioner in the form of a metal rod 44 is positioned between the liners 38 and 40 and extends from the flap 16 to the base 12, through openings (not shown) in the sheet of corrugated material 42. The rod does not extend to the outer edge of the flap 16 but is recessed therefrom in the vicinity of a V-shaped notch 46. The rod 44 can be inserted into the board after it is cut and scored to produce the blank 10, as shown in FIG. 2. The rod 44 can produce the openings (not shown) in the corrugated material 42 as the rod 44 is inserted into the board. The rod 44 can be removed in order to facilitate recycling of the board from which it is made. A similar rod (not shown) is similarly positioned so that it is carried in the base 12 and the flap 20.

Figure 3:
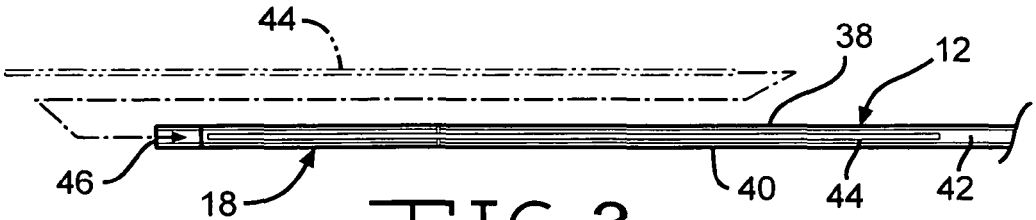
FIG. 3 is a cross-sectional view, taken along the line 3-3 of FIG. 1.

Referring now to FIG. 3, another metal rod 44 is positioned between the liners 38 and 40 and extends from the flap 18 to the base 12, and may be contained entirely within one flute of the corrugated material 42. The rod 44 does not extend to the outer edge of the flap 16 but is recessed therefrom in the vicinity of a V-shaped notch 46. The rod 44 can be inserted into the board, in the V-shaped notch, after it is cut and scored to produce the blank 10, as shown in FIG. 3. The rod 44 can be removed in order to facilitate recycling of the board from which it is made. A similar rod (not shown) is similarly positioned so that it is carried in the base 12 and the flap 14.

Figure 4:
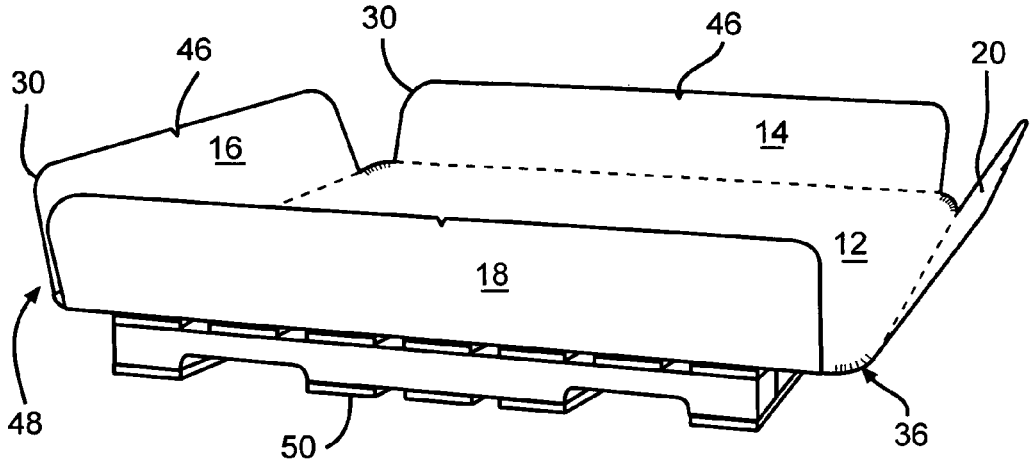
FIG. 4 is a perspective view of a load tray according to the invention with erected flaps seated on a pallet.

When the flap 16 is pivoted about the score line 24 from the position shown in FIGS. 1 and 2, where it is co-planar with the base 12 to a position where it is raised, the rod 44 will bend and will remain bent so as to keep the flap 16 in the pivoted position, for example, as shown in FIG. 4. Similarly, when the flap 18 is pivoted about the score line 26 from the position shown in FIGS. 1 and 2, where it is co-planar with the base 12 to a position where it is raised (FIG. 4), the rod 44 will bend and will remain bent so as to keep the flap 18 in the pivoted position. The rods 44 will permit further pivoting of the flaps from the position shown in FIG. 4. Such pivoting will occur when a palletized load including the load tray is wrapped, as discussed hereinbelow. Other devices for maintaining flaps in a pivoted position are described below with reference to FIG. 13.

Turning now to FIG. 4, the flaps 14, 16, 18 and 20 have been pivoted to a raised, ready position in which they are maintained by the flap positioners. This can be done on-site where a load is to be palletized and wrapped. The blank 10 (FIG. 1) can be shipped flat, in the manner illustrated in FIG. 1, to a product loading site and erected on site to produce a load tray 48. In practice, the flaps 14, 16, 18 and 20 should form an angle with the central base 12 of 135 degrees or less. A preferred range of angles is 135 to 90 degrees.

The tray 48 is especially adapted to be used with a pallet 50. The relative sizes of the load tray 48 and the pallet 50 are very significant. For example, the central base 12 has a larger area than the footprint of the pallet 50. For example, with the GMA pallet which is 48 inches by 40 inches, excellent results have been obtained with a load tray having a central base that is 52.2 inches by 44.2 inches. The height of the flaps is significant and excellent results have been obtained in a load tray having a central base that is 52.2 inches by 44.2 inches, with flaps having a height of 7 inches. In such a load tray, wire rods having diameters of 1/16 of an inch and lengths of 12 inches have worked very well.

In some applications, it is desirable to impart a non-skid property to the upper/interior surface of the central base 12 and this can be achieved with the application of commercially available products such as Softak from Michelman which increases the skid angle of paper up to as much as 30 to 45 degrees. Softak is re-pulpable so it will not interfere with the recycling of the load tray. By increasing the skid angle, palletized loads will be more apt to stay in place while the load is being wrapped.

Figure 5:
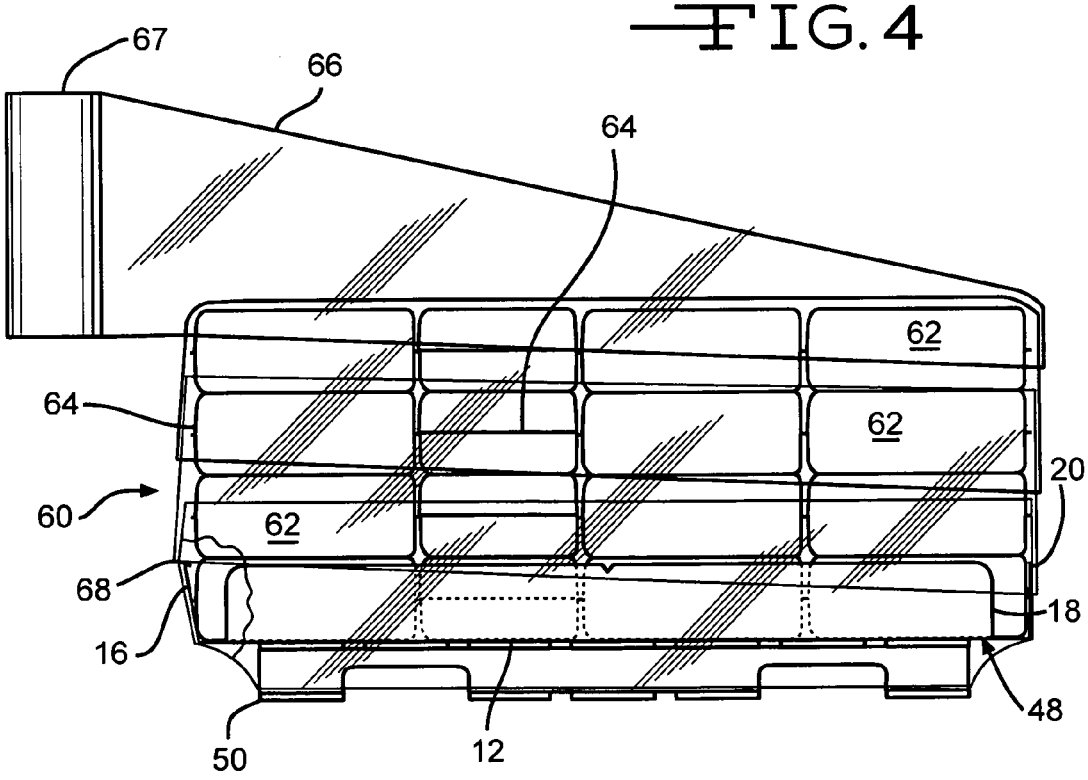
FIG. 5 is a side view of a palletized load including a load tray according to the invention as it is being wrapped with film.

Turning now to FIG. 5, a unitized palletized load is indicated generally at 60. The load is made up of bags 62 with closed, seamed ends 64, i.e., the ends have been sewn or glued shut. These could be bags of pet food or grass seed or anything else that is suitably packaged in bags. Such bagged products are particularly susceptible to being damaged when they are palletized and moved. The bags have been stacked on a tray 48 which has been positioned on top of a pallet 50. The bags, the load tray 48 and the pallet 50 have been unitized by being wrapped with film 66 from a spool 67. The film 66 can be stretch wrap film or heat shrink film or any kind of film which can be wrapped around the load and the pallet and apply tension to the load to unitize the load by compressing or hugging it. These kinds of film will be referred to as tension films. When the bags 62 were being placed onto the tray 48, the tray flaps 14 (not shown) 16, 18 and 20 were in a raised position which is represented by the position shown for flap 16, which can be seen where a portion of the film 66 has been cut away to show the pre-wrap flap position. An end 68 of the flap 16 is sticking out from the bags 62 that make up the load. After the load has been wrapped in film and compressed, the flaps all are pressed against the load in the manner shown for flap 20, which is shown in a post wrap position. The flap 20 and the other flaps are pressed tight against the load and, for the load shown in FIG. 5, after wrapping, the flaps are in about a vertical position forming an angle of about ninety degrees with the central base 12 of the tray 48. The footprint of the load illustrated in FIG. 5 is just about equal to the area of the central base 12 of the tray 48. Loads with relatively smaller footprints are shown in FIGS. 6 and 7.

The rounded corners 30 (FIGS. 1 and 4) of the flaps 14, 16, 18 and 20 are kind to the film wrap 66 and do not tend to cut or pierce it the way straight corners tend to cut or pierce or compromise film wraps. This is also true for the rounded corners 36 (FIGS. 1 and 4) of the central base 12 of the tray 48. The corners 36 do not tend to cut or pierce a film wrap the way straight corners tend to cut or pierce or compromise film wraps.

Figure 6:
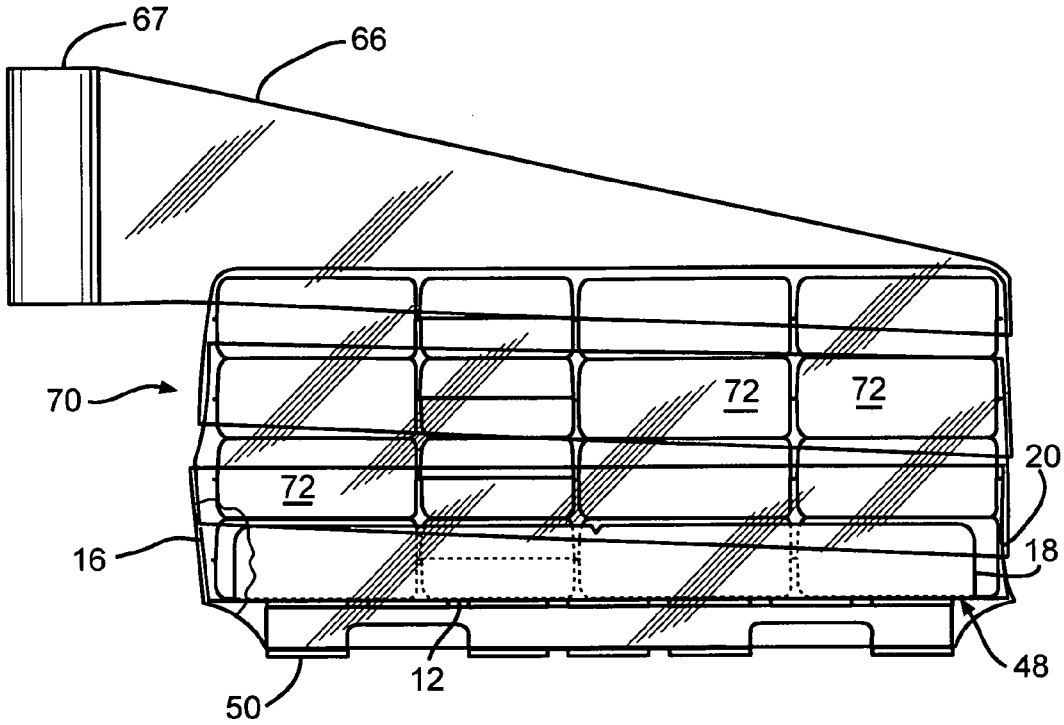
FIG. 6 is a side view of a palletized load that is similar to FIG. 5 except that the load of the palletized load in this Fig. has a smaller footprint, relative to the load tray, than the load depicted in FIG. 5.

In FIG. 6, a unitized palletized load is indicated generally at 70. The load is made up of bags 72 stacked onto the central base 12 of the load tray 48. The load of bags 72 has a footprint that is smaller, relative to the central base 12, than the load of bags 62 shown in FIG. 5. When the bags 72 (FIG. 6) were being placed onto the tray 48, the tray flaps 14 (not shown) 16, 18 and 20 were in a raised position which is represented by the position shown for flap 16, which can be seen where a portion of film 66 has been cut away to show the pre-wrap flap position. After the load 70 has been wrapped in film and compressed, the flaps all are pressed against the load in the manner shown for flap 20, which is shown in a post wrap position. The flap 20 and the other flaps are pressed tight against the load and, for the load shown in FIG. 6, after wrapping, the flaps are past a vertical position forming an acute angle of less than ninety degrees with the central base 12 of the tray 48. The footprint of the load illustrated in FIG. 6 is less than the area of the central base 12 of the tray 48. As it is wrapped and placed under compression, however, the flaps embrace the sides of the bags 72 that constitute the load, giving the load good integrity and integrating the tray 48 into the load.

Figure 7:
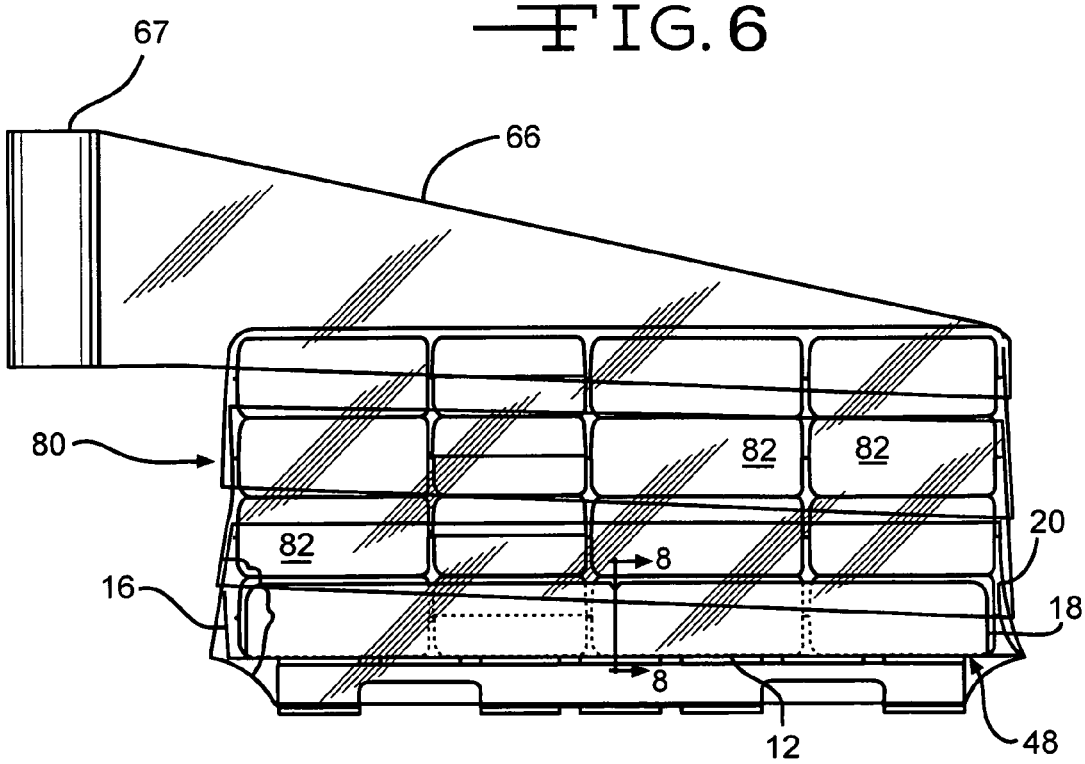
FIG. 7 is a side view of a palletized load that is similar to FIG. 6 except that the load of the palletized load in this Fig. has a smaller footprint, relative to the load tray, than the load depicted in FIG. 6.

In FIG. 7, a unitized palletized load indicated generally at 80 is constituted by bags 82. The load of bags 82 has a footprint that is even smaller, relative to the central base 12, than the load of bags 72 shown in FIG. 6. When the bags 82 (FIG. 7) were being placed onto the tray 48, the tray flaps 14 (not shown) 16, 18 and 20 were in a raised position which is represented by the position shown for flap 16, which can be seen where a portion of film 66 has been cut away to show the pre-wrap flap position. After the load 80 has been wrapped in film and compressed, the flaps all are pressed against the load in the manner shown for flap 20, which is shown in a post wrap position. The flap 20 and the other flaps are pressed tight against the load and, for the load shown in FIG. 7, after wrapping, the flaps are well past a vertical position forming an acute angle of substantially less than ninety degrees with the central base 12 of the tray 48. This angle is more acute than the angle between the flap 20 and the central base shown in FIG. 6. The footprint of the load illustrated in FIG. 7 is significantly less than the area of the central base 12 of the tray 48. The footprint of the load is recessed from the perimeter of the central base substantially but the distance by which it is recessed is substantially less than the length of the flaps 14, 16, 18 and 20. As the load of bags 82 is wrapped and placed under compression, the flaps embrace the sides of the bags 82 that constitute the load, giving the load good integrity and integrating the tray 48 into the load.

From the description of FIGS. 5, 6 and 7, one begins to understand the versatility provided by the load tray 48 in terms of the various footprints of loads which a single sized tray 48 can accommodate. The flaps, when placed under tension by a film wrap, embrace the components that make up the load, regardless of the size of the load relative to the tray 48.

Figure 8:
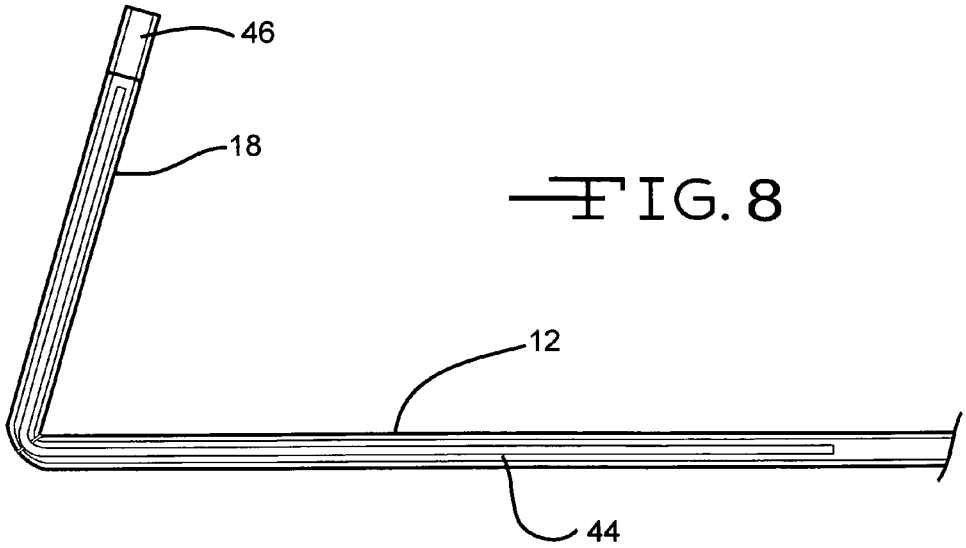
FIG. 8 is a cross sectional view taken along the line 8-8 in FIG. 7.

In FIG. 8, the flap 18 is shown forming an acute angle with the central base 12 of the tray. The flap positioner constituted by the rod 44 has accommodated the pivoting of the flap 18 to the FIG. 8 position by bending with the flap 18 as it is pivoted. The pivoting of the flap 18 is caused by the tension applied to the flap 18 and the other flaps by the tension film. In practice, the flap 18 will have more of a curve like flap 20 in FIG. 7.

Figure 9:
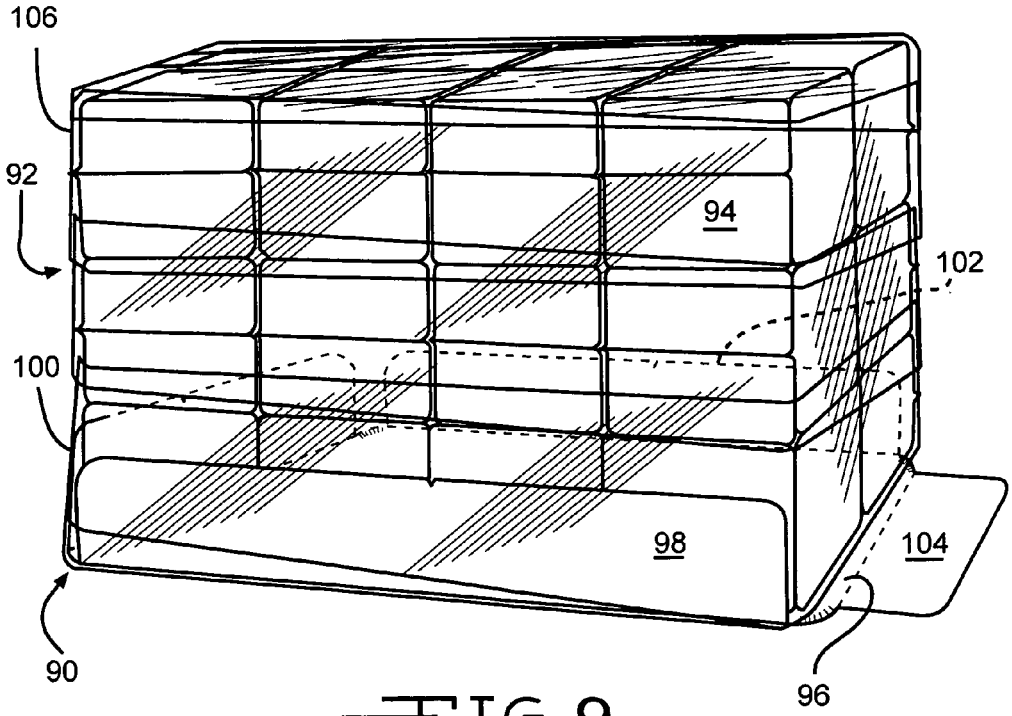
FIG. 9 is a perspective view of a wrapped load including a load tray according to the invention but not including a pallet where one of the four flaps was not erect when the load was wrapped, leaving one flap exposed so that the load tray may serve as a load sled.

A skid tray 90 is shown in FIG. 9 as part of a non-palletized unitized load indicated at 92 and constituted by bags 94. The skid tray 90 corresponds, generally, with the load tray 48 but is used a little differently. The skid tray comprises a central base 96 and three load flaps 100, 102 and 104 pivotally connected to the central base 96. Flap positioners (not shown) are provided for the flaps 100, 102 and 104 to maintain those flaps in a pre-wrap position, forming an obtuse angle with the central base 96 somewhere between 90 and about 135 degrees. One hundred and ten degrees is an angle that has performed very well. The angle needs to be small enough so that, when a tension wrap is applied, the wrap will act on the flaps and the flaps will easily pivot until the flap or at least a portion of the flap engages the items that make up the load. A fourth flap, a skid flap 106, is connected to the central base 96 but is not pivoted to a pre-wrap position like the other flaps 98, 100 and 102. As a consequence, skid flap 104 is not pressed against the items that make up a load but remains outside of tension wrap 106 when it is applied to the load, thereby leaving the skid flap 104 accessible to be engaged by a skid flap grabber on a skid steer or the like. Features of the load tray 48 including the rounded corners 30, the flexible fingers 36, the score lines between the flaps and the central base and other features are readily and preferably incorporated into the skid tray 90.

In a method for using the skid tray 90, the flaps 98, 100 and 102 are pivoted to a pre-wrap position and items making up a load are stacked on the central base 96. Tensioning wrap is then wrapped around the items in the load so that it captures the flaps 98, 100 and 102 pressing them tightly against the load, while care is taken not to capture the skid flap 104 so that it remains exposed and accessible for engagement by a skid steer.

Figure 10:
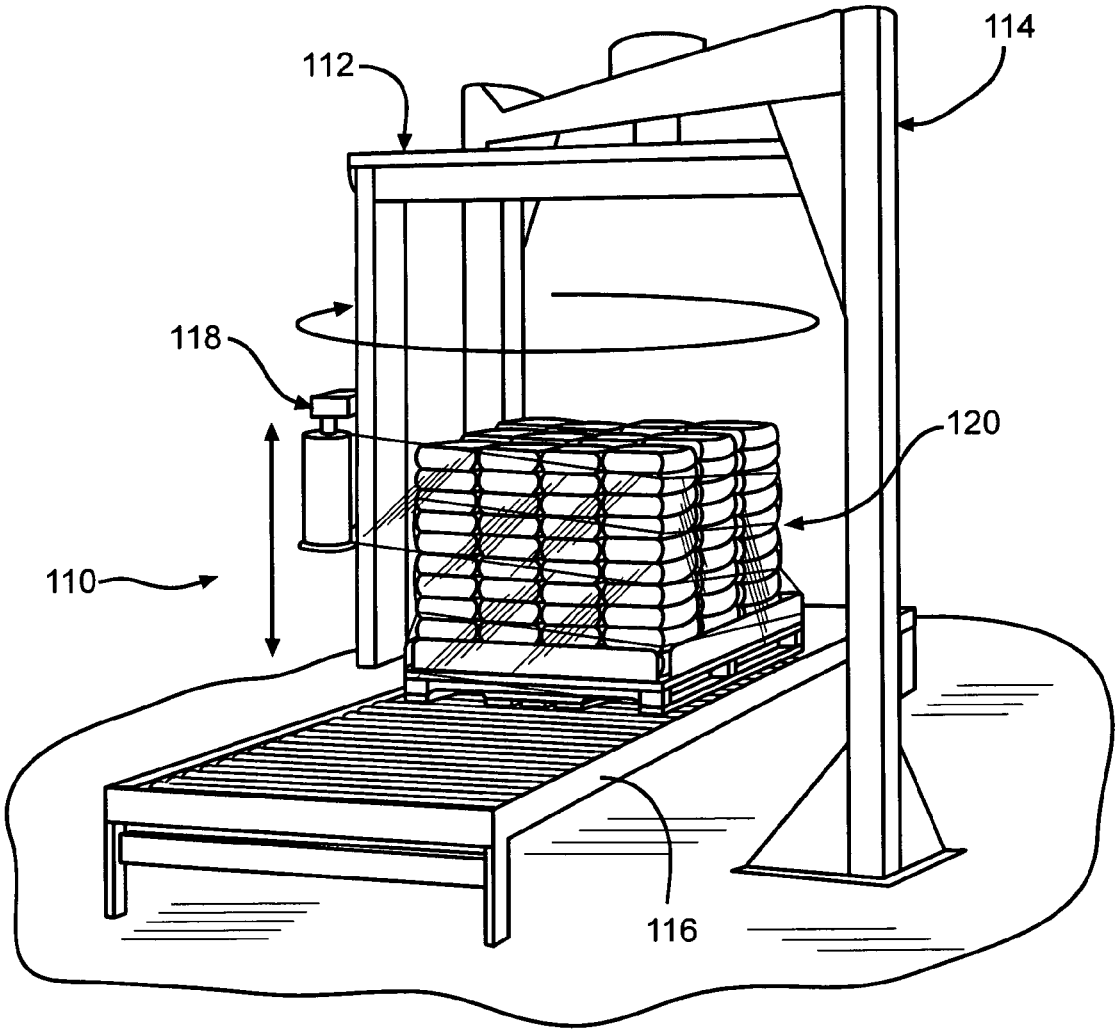
FIG. 10 is a perspective view palletized load in a wrapping station of automated wrapping machinery.

In FIG. 10, a tensioning wrap station is indicated generally at 110. A rotating carriage 112 is mounted on a frame 114 which spans a conveyor 116 on which loads are moved to and through the station 110. A tensioning wrap spool support 118 is mounted for reciprocating vertical movement on the carriage 112 so that, as the carriage rotates around a load 120, typically starting at the lowest level, wrap is unspooled and encircles the load. The spool support then rises on the carriage 112 as the carriage continues to rotate around the load 120, thereby wrapping the load 120 substantially as shown. In the case where stretch wrap is applied to the load, the wrap, as applied, places the load in compression thereby unitizing the load. In the case where heat shrink wrap is applied to the load, heat would then be applied to the load to shrink the wrap thereby placing the load in compression and unitizing the load. In both cases, the flaps are moved by compression of the load from the pre-wrap position, where the free ends of the flaps are spaced from the load, to a unitized position, where at least the free ends of the flaps are pressed against and held against the load.

Figure 11:
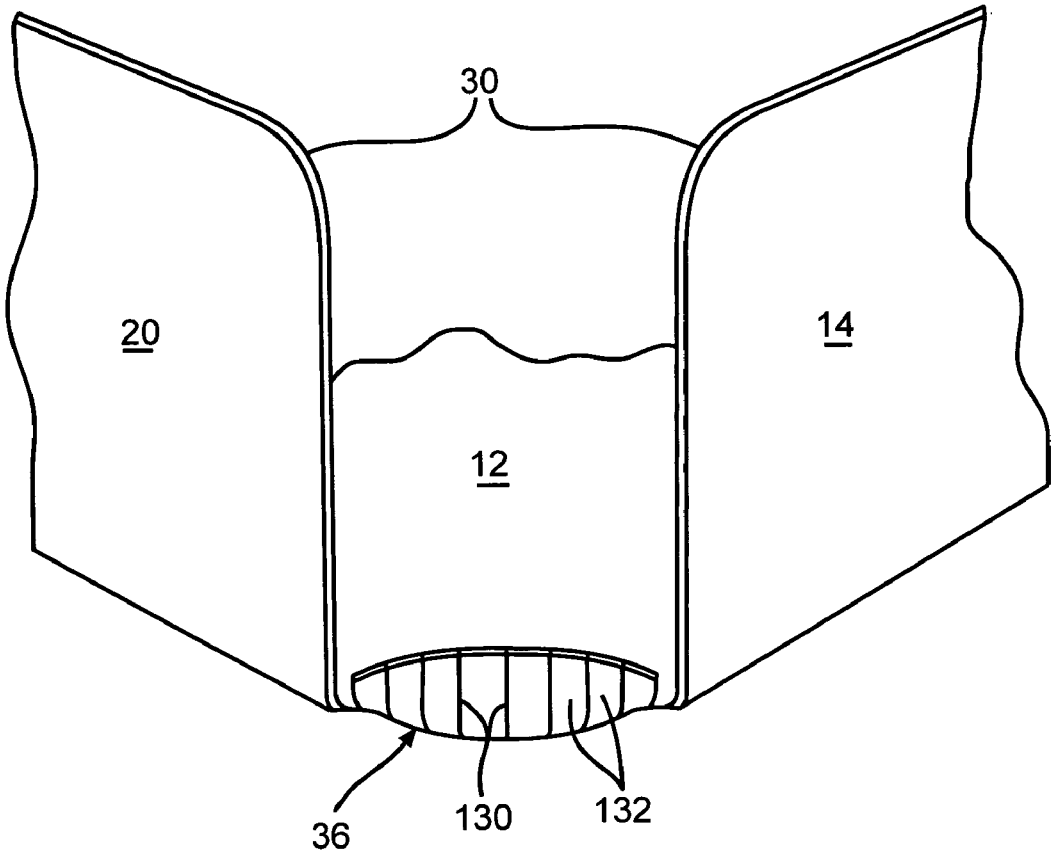
FIG. 11 is a detailed view of flexible fingers extending from the load tray base.

In FIG. 11, some details concerning the rounded corners 36 of the central base 12 (FIG. 1) are illustrated. The central base corners 36, one of which is illustrated in FIG. 11, are rounded, as discussed above with reference to FIG. 1. The rounded corners 36 are made even more friendly to tensioning wrap by slits, indicated at 130 in FIG. 11, that are cut in the rounded corners 36. The slits 130, which extend in a generally radial direction relative to the rounded corners 36, reduce the ability of the rounded corners 36 to resist deformation, thereby making the rounded corners more friendly to tensioning wrap, i.e., less likely to tear or pierce or compromise tensioning wrap applied to the corners 36. In other words, the slits 130 make the corners 36 more crushable or deformable, minimizing damage to tensioning wrap applied to the corners. As tensioning wrap compresses a load seated on the central base, the wrap presses tight against the rounded corners 36. The slits 130 create flexible fingers 132 which deform much more easily than would the entire rounded corner 36 if left intact. So, as the load is compressed by tensioning wrap, the individual flexible fingers 132 will deform and pivot upwardly, as shown in FIG. 11, or downwardly (not shown) but, in any case, the flexible fingers 132 will deform and distribute the compressive load applied by the tensioning wrap, minimizing the potential for damage to or compromising of the wrap.

Figure 12:
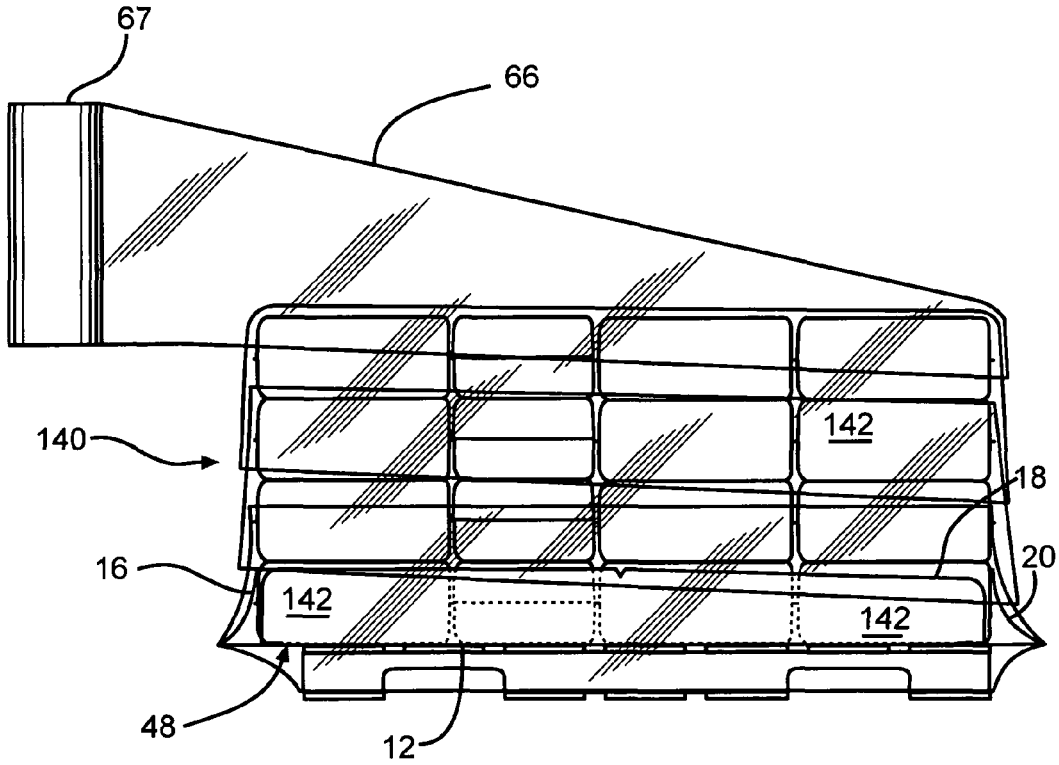
FIG. 12 is a side view of a palletized load that is similar to FIG. 7 except that the load of the palletized load in this Fig. has an even smaller footprint, relative to the load tray, than the load depicted in FIG. 7.

Referring now to FIG. 12, a unitized palletized load is indicated generally at 140. The load is made up of bags 142 although the load could be made up of any type of packaged or even unpackaged goods. In the load 140, the bags 142 are skewed. The bags 142 are on the central base 12 of the tray 48 but they are not centered. For example, the bags 142 at the bottom of the load are closer to the flap 20 than they are to the flap 16. However, in the load 140, this is easily accommodated because the flap 20 has pivoted further than the flap 16 so that their upper edges are both pressed neatly against the side of the bags 142 in the load, although the flaps 16 and 20 are at different angles. The sides and ends of the bags 142 are not exactly aligned with the central base either, .i.e., the sides of the load are not parallel to the score lines (not shown in FIG. 12) that define the central base 12. Again, this is easily accommodated by the load tray 48 because the flap 18 has simply conformed to the side of the load of bags 142. Thus, it will be seen that the load tray 48 is able to accommodate imprecision in the placement of a load on it. The upper edges of the flaps 14, 16, 18 and 20 simply find the side of the load when tensioning wrap is applied to the load, even when the load is not centered perfectly on the central base 12 of the tray 48. It can also be observed in this FIG. 12 that the tray 48 is not centered exactly on the pallet 50. Again, because of the design of the tray 48, the tensioning wrap is able to overcome the fact that the tray 48 is not centered on the pallet 50 and still produce a unitized palletized load with excellent integrity.

Figure 13:
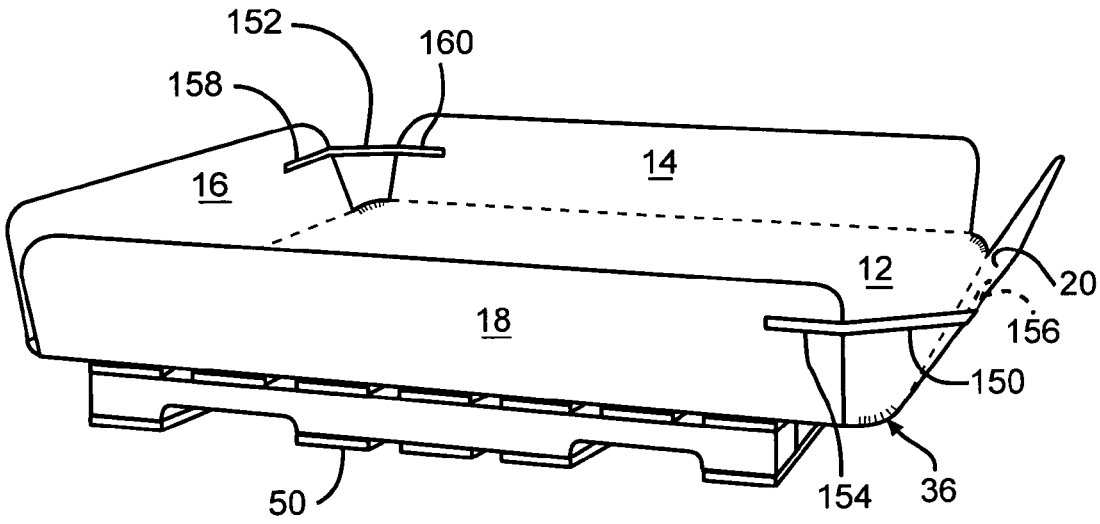
FIG. 13 is a perspective view of a load tray showing alternative flap positioners.

In terms of flap positioners, the rods 44 (FIGS. 2, 3 and 8) are but one option. Second and third options are illustrated in FIG. 13 and comprise a cord 150 and/or a cord 152. The cord 150 is adhesively connected to the flaps 18 and 20, near the upper edges of the flaps. The flaps 18 and 20 can't pivot to be co-planar with the central base because the cord 150 prevents the flaps from separating from each other beyond the amount by which they are separated in FIG. 13. An end portion 154 of the cord 150 is connected, adhesively or otherwise, to the outside of flap 18 and an end portion 156 of the cord 150 is attached, adhesively or otherwise, to the outside of the flap 20 while the flaps 18 and 20 are pivoted, relative to the central base 12, to the illustrated positions. An end portion 158 of the cord 152 is connected, adhesively or otherwise, to the inside of flap 16 and an end portion 160 of the cord 152 is attached, adhesively or otherwise, to the inside of the flap 14 while the flaps 14 and 16 are pivoted, relative to the central base 12, to the illustrated positions.

Figure 14:
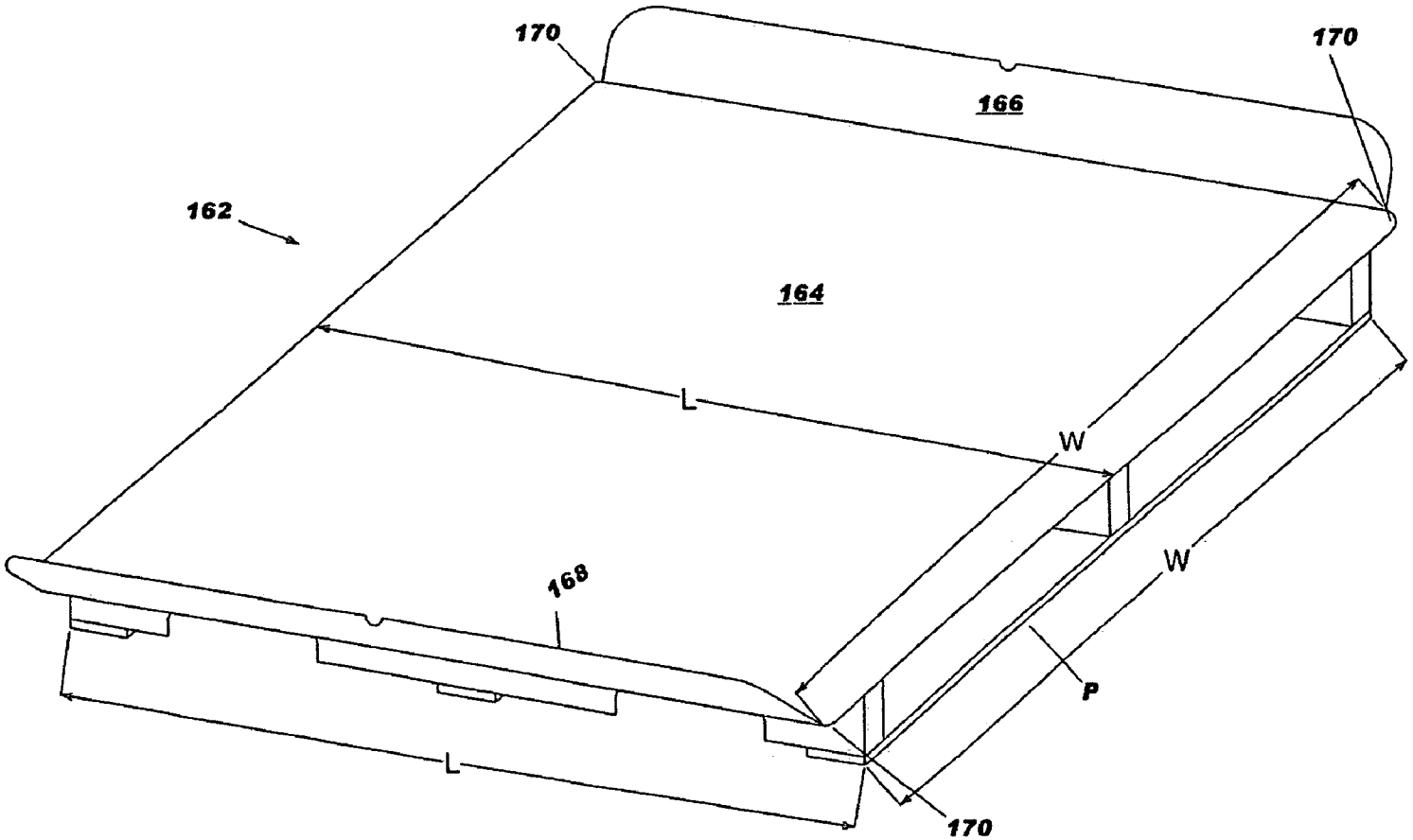
FIG. 14 is a perspective view of a two flap embodiment of a load tray according to the invention.

Turning now to FIG. 14, a two flap load tray is indicated generally at 162 and comprises a central load supporting base 164, a first flap 166 and a second flap 168. The flaps 166 and 168 are pivotally connected to the central base 164 and, specifically, hingedly connected to opposing ends of the base 164. The central base 164 has a width W and a length L. The flaps 166 and 168 have a width that is shorter than the length L of the base. In the embodiment shown is FIG. 14, the footprint of the central base 164 is larger than the pallet P. In other words, the length L of the central base 164 is longer than the length L of the pallet P and the width W of the central base 164 is wider than the width W of the pallet P. The central base 164 has four exposed corners 170 which do not incorporate the flexible fingers described above in connection with other embodiments of load trays. Flap positioners (not shown) are provided to releasably maintain the flaps 166 and 168 in pre-wrap positions.

Figure 15:
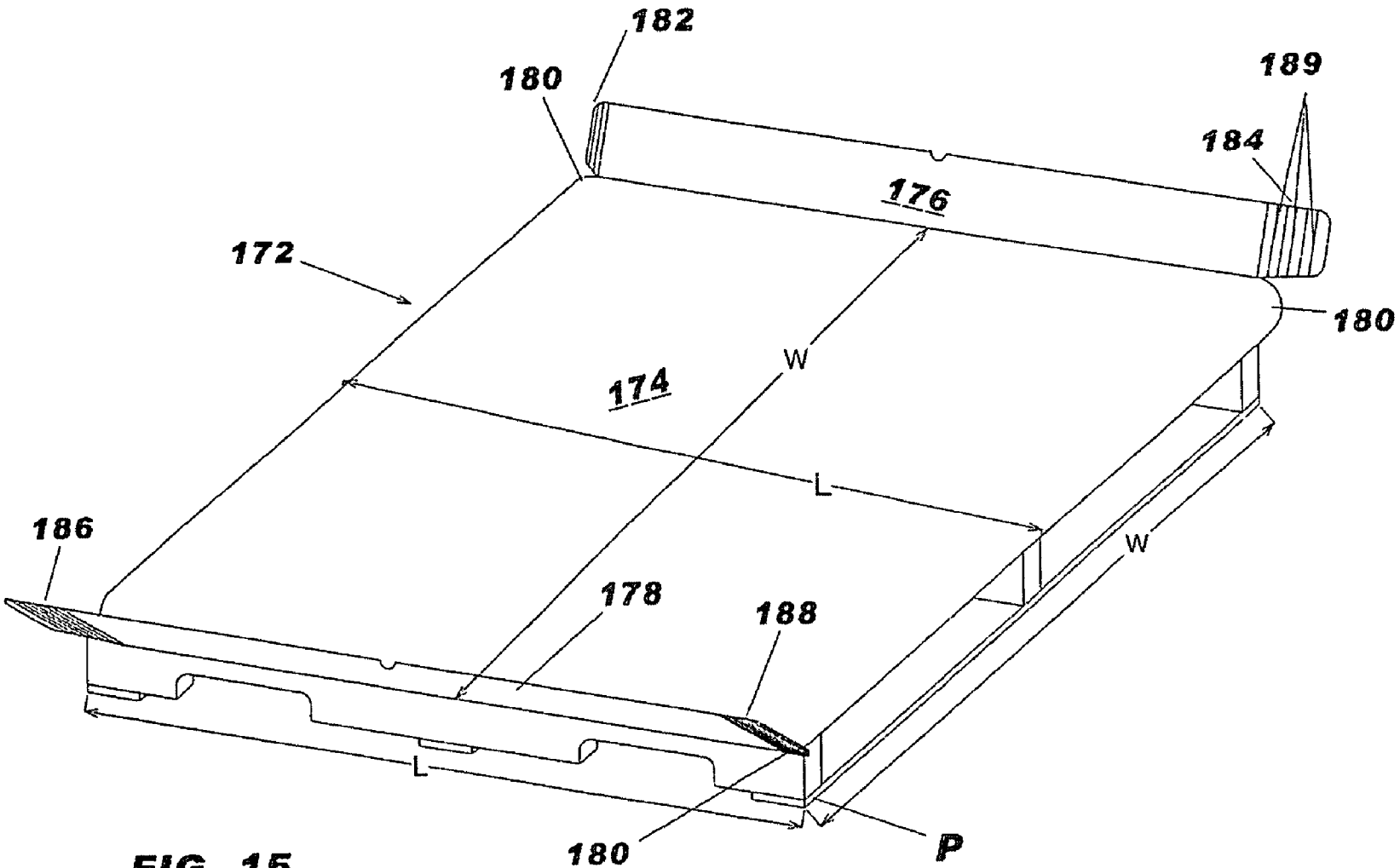
FIG. 15 is a perspective view of a second embodiment of a two flap load tray according to the invention.

In FIG. 15, a second embodiment of a two flap load tray is indicated generally at 172. The load tray comprises a central load supporting base 174 a first flap 176 and a second flap 178. The flaps 176 and 178 are pivotally connected to the central base 174 and, specifically connected to opposing ends of the base 174. The central base 174 has width W and a length L. In the embodiment shown in FIG. 15, the footprint of the central base 174 is larger than the pallet P. In other words, the length L of the central base 174 is longer than the length L of the pallet P and the width W of the central base 174 is wider than the width W of the pallet P. The central base 174 has four exposed corners 180 which do not incorporate the flexible fingers described above in connection with other embodiments of load trays, although the flexible fingers which can act as crush zones may be incorporated here and also in the load tray 162. In this embodiment, the flap 176 has ends 182 and 184 and the flap 178 has ends 186 and 188. The ends 182 and 184 extend outwardly beyond the end points of the hinged connection between the flap 176 and the central base 174. In like fashion, the ends 186 and 188 extend outwardly beyond the end points of the hinged connection between the flap 178 and the central base 174. Each of the flaps 176 and 178 are scored near their ends 182, 184, 186 and 188, as indicated at 190 in connection with flap 184. The scores 190 facilitate bending of the flap ends around a load (not shown) when it is wrapped. This provides a wrapping feature by which the load tray flap ends 182, 184, 186 and 188 can wrap around and protect the lower corners/edges of a load (not shown). Flap positioners (not shown) are provided to releasably maintain the flaps 176 and 178 in pre-wrap positions.

Figure 16:
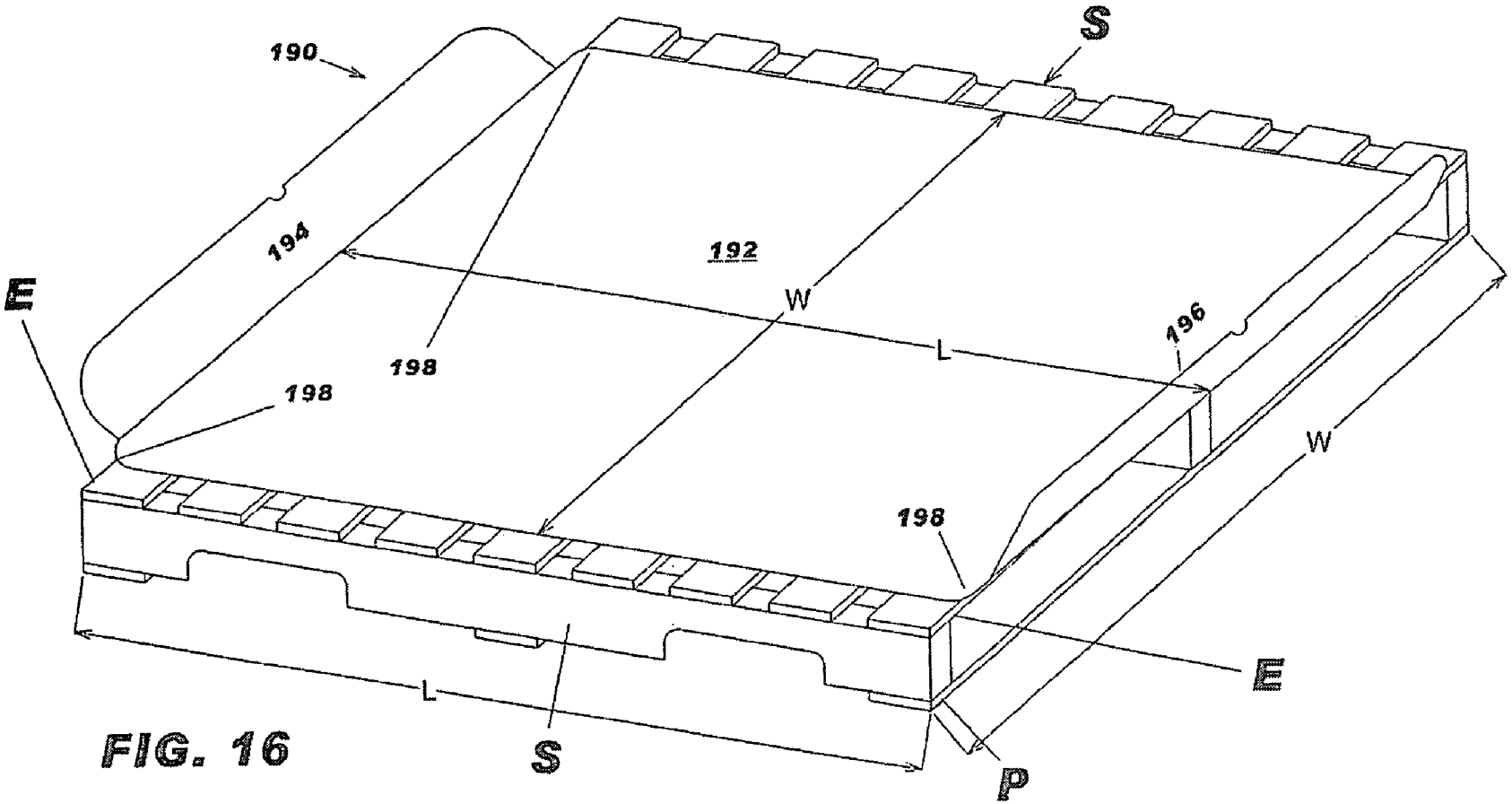
FIG. 16 is a perspective view of a third embodiment of a two flap load tray according to the invention.

In FIG. 16, a third embodiment of a two flap load tray is indicated generally at 190 and comprises a central load supporting base 192, a first flap 194 and a second flap 196. The flaps 194 and 196 are pivotally connected to the central base 192 and, specifically, they are connected to opposing ends of the base 192. The central base 192 has width W and a length L. The flaps 194 and 196 have widths that extend along most of the length L of the base 192, but the widths of the flaps 194 and 196 are shorter than the length L of the base 192. The load tray 190 has the same components as the load tray 162 shown in FIG. 14. However, the relative sizes and orientations of the load tray 190 and the pallet P are different than those of the load tray 162 and the pallet P in FIG. 14. In FIG. 16, the flaps 194 and 196 extend along the width W of the pallet P while the flaps 166 and 168 (FIG. 14) extend along the length L of the pallet P. In FIG. 14, the width W of the load tray 162 is aligned with the width W of the pallet P while in FIG. 16, the width W of the load tray 190 is aligned with the length L of the pallet P. In other words, the load tray 190 is oriented on the pallet P in FIG. 16 so that it is rotated ninety degrees from the orientation of the load tray 162 on the pallet P shown in FIG. 14.

In the load tray 190 shown in FIG. 16, the area of the footprint of the central base 192 (L×W) is smaller than the area of the footprint of the pallet P (L×W). Specifically, the length L of the base 192 is less than the width W of the pallet so that portions of the top of the pallet P are exposed and not covered by the central base 192. The width W of the central base 192 is just a little longer than the length L of the pallet P so that portions of the central base 192 adjacent to the flaps 194 and 196 extend just a little bit beyond the corresponding or adjacent ends E of the pallet P. So, the central base 192 overlaps two opposed ends of the pallet P and is recessed from two opposed sides S of the pallet P. The flaps 194 and 196 are oriented so that they extend along the length L of the central base 192 and they extend a distance that is slightly less than the length L of the central base 192. However, the flaps 194 and 196 extend along the width W of the pallet P on which the tray 190 sits. The central base 192 has four exposed corners 198 which do not incorporate the flexible fingers described above in connection with other embodiments of load trays. Flap positioners (not shown) are provided to releasably maintain the flaps 194 and 196 in pre-wrap positions.

Figure 17:
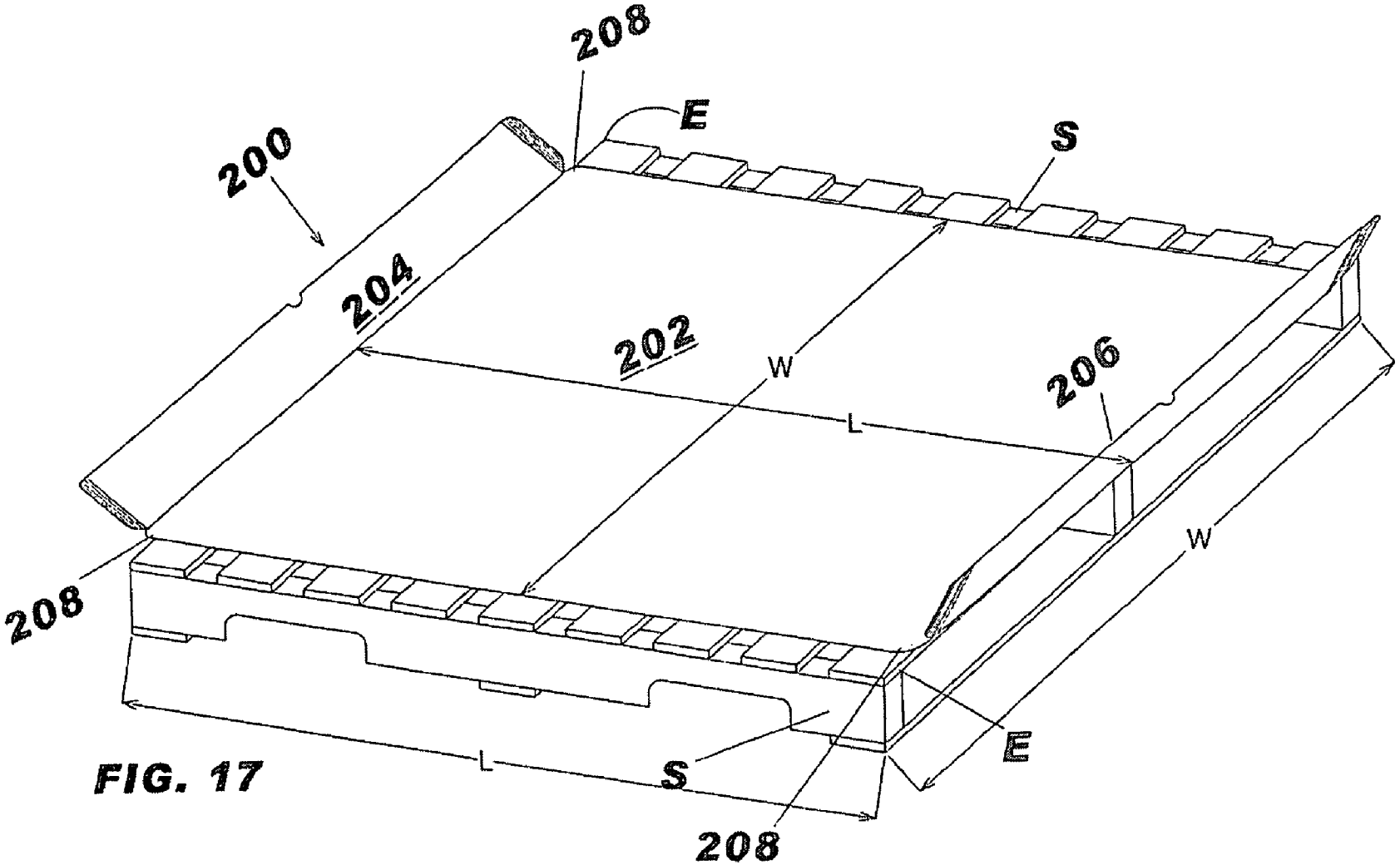
FIG. 17 is a perspective view of a fourth embodiment of a two flap load tray according to the invention.

In FIG. 17, a fourth embodiment of a two flap load tray is indicated generally at 200 and comprises a central load supporting base 202, a first flap 204 and a second flap 206. The flaps 204 and 206 are pivotally connected to the central base 202 and, specifically, they are connected to opposing ends of the base 202. The central base 202 has a width W and a length L. The flaps 204 and 206 have widths that extend along most of the length L of the base 202, but the widths of the flaps 204 and 206 are shorter than the length L of the base 202. The load tray 200 corresponds generally with the load tray 172 of FIG. 15, except that the relative sizes and orientations of the load tray 200 and the pallet P are different than those of the load tray 172 and the pallet P in FIG. 15. In FIG. 17, the flaps 204 and 206 extend along the width W of the pallet P while the flaps 176 and 178 (FIG. 15) extend along the length L of the pallet P. In FIG. 15, the width W of the load tray 172 is aligned with the width W of the pallet P while in FIG. 17, the width W of the load tray 200 is aligned with the length L of the pallet P. In other words, the load tray 200 is oriented on the pallet P in FIG. 17 so that it is rotated ninety degrees from the orientation of the load tray 172 on the pallet P shown in FIG. 15.

In the load tray 200 shown in FIG. 17, the area of the footprint of the central base 202 (L×W) is smaller than the area of the footprint of the pallet P (L×W). Specifically, the length L of the base 202 is less than the width W of the pallet so that portions of the top of the pallet P are exposed and not covered by the central base 202. The width W of the central base 202 is just a little longer than the length L of the pallet P so that portions of the central base 202 adjacent to the flaps 204 and 206 extend just a little bit beyond the corresponding or adjacent ends E of the pallet P. So, the central base 202 overlaps two opposed ends E of the pallet P and is recessed from two opposed sides S of the pallet P. The flaps 204 and 206 are oriented so that they extend along the length L of the central base 202 and they extend a distance that is slightly less than the length L of the central base 202. However, the flaps 204 and 206 extend along the width W of the pallet P on which the tray 200 sits. The central base 202 has four exposed corners 208 which do not incorporate the flexible fingers described above in connection with other embodiments of load trays. Flap positioners (not shown) are provided to releasably maintain the flaps 204 and 206 in pre-wrap positions.

It will be appreciated that considerable departures from the specific details of the embodiments of the invention described above, are possible without departing from the spirit and scope of the inventions as it is defined in the following claims. Further, it will be appreciated that features shown and described in connection with certain ones of the disclosed embodiments can be combined with features shown and described in connection with certain other ones of the disclosed embodiments in cases specifically mentioned above and in other cases as well.

We claim:

1. A load tray comprising a central base having four sides and four rounded corners and having a length and a width, four flaps hingedly connected to said central base, two of said flaps being connected to said central base along its width but having a width that is less than the width of said central base and the other two of said flaps being connected to said central base along its length but having a width that is less than the length of said central base and at least three flap positioners connected to three of said flaps and operable to releasably maintain said flaps in a position where they form angles with said central base of between ninety and one hundred thirty five degrees.

2. The tray claimed in claim 1 wherein flexible fingers are formed in said rounded corners of said central base.

3. A load tray comprising a central base having four sides and four rounded corners and having a length and a width, at least two flaps hingedly connected to said central base, two of said at least two flaps being connected to said central base along its width but having a width that is less than the width of said central base and at least two flap positioners connected to said at least two flaps and operable to releasably maintain said at least two flaps in a position where they form angles with said central base of between ninety and one hundred thirty five degrees.

4. A method for unitizing a pallet load, said method comprising the steps of providing a pallet having two opposed ends, two opposed sides and an upper load supporting surface, providing a load tray comprising a central base having four sides and four rounded corners and having a length and a width, at least two flaps hingedly connected to said central base, two of said at least two flaps being connected to said central base along its width but having a width that is less than the width of said central base and at least two flap positioners connected to said at least two flaps and operable to releasably maintain said at least two flaps in a position where they form angles with said central base of between ninety and one hundred thirty five degrees, positioning said central base of said load tray on said upper load supporting surface of said pallet with said at least two flaps releasably maintained in positions where they extend outwardly away from said central base and they extend upwardly away from said pallet, positioning a load comprising a plurality of packages on said central base, between said at least two flaps so that free ends of said at least two flaps are spaced away from the packages which make up the load, and wrapping the load, the load tray and the pallet with wrapping material so that the wrapping material engages the free ends of said at least two flaps and draws those ends up tight against the load.

* * * * *